US012385114B2

(12) United States Patent
Campaniello et al.

(10) Patent No.: US 12,385,114 B2
(45) Date of Patent: Aug. 12, 2025

(54) HOT ROLLED STEEL STRIP HAVING IMPROVED PROPERTIES

(71) Applicant: TATA STEEL IJMUIDEN B.V., Velsen-Noord (NL)

(72) Inventors: Jean Joseph Campaniello, Heerhugowaard (NL); Calum McEwan, The Hague (NL); Jaap Teyhoff, Alkmaar (NL); Natalia Vadimovna Luzginova, Heerhugowaard (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 497 days.

(21) Appl. No.: 17/906,043

(22) PCT Filed: Mar. 12, 2021

(86) PCT No.: PCT/EP2021/056412

§ 371 (c)(1),
(2) Date: Sep. 9, 2022

(87) PCT Pub. No.: WO2021/180964

PCT Pub. Date: Sep. 16, 2021

(65) Prior Publication Data

US 2023/0151466 A1 May 18, 2023

(30) Foreign Application Priority Data

Mar. 13, 2020 (EP) ..... 20163099

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C22C 38/14* (2013.01); *C21D 8/0226* (2013.01); *C22C 38/008* (2013.01); *C22C 38/02* (2013.01); *C22C 38/04* (2013.01); *C22C 38/06* (2013.01); *C22C 38/12* (2013.01)

(58) Field of Classification Search

CPC ..... C21D 8/0226

See application file for complete search history.

(56) References Cited

U.S. PATENT DOCUMENTS

| | | | | |
|---|---|---|---|---|
| 6,488,790 | B1 | 12/2002 | Hartmann et al. | |
| 2015/0354021 | A1 | 12/2015 | Rijkenberg | |
| 2017/0275724 | A1 * | 9/2017 | McEwan | C21D 6/005 |

FOREIGN PATENT DOCUMENTS

| | | | |
|---|---|---|---|
| EP | 2599887 | A1 | 6/2013 |
| JP | 2007211334 | A | 8/2007 |
| JP | 2007231352 | A * | 9/2007 |
| WO | 2016030010 | A1 | 3/2016 |
| WO | 2018055098 | A1 | 3/2018 |

OTHER PUBLICATIONS

Written Opinion and International Search Report for corresponding PCT Application No. PCT/EP2021/056412 filed Mar. 12, 2021.

Machine translation of JP 2007-231352 A to Hasegawa, filing date Feb. 28, 2006, published Sep. 13, 2007, from JPO J-PlatPat, URL :<https://www.j-platpat.inpit.go.jp/p200>, retrieved from the Internet Apr. 30, 2025.

* cited by examiner

*Primary Examiner* — Christopher S Kessler

(74) *Attorney, Agent, or Firm* — Vorys, Sater, Seymour and Pease LLP; Anthony P. Venturino; Maryellen Feehery Hank

(57) ABSTRACT

A hot rolled steel strip, in particular an HSLA hot rolled steel strip, in which Nb and Ti are used as micro-alloying elements.

18 Claims, No Drawings

HOT ROLLED STEEL STRIP HAVING IMPROVED PROPERTIES

The invention relates to a hot rolled steel strip. More particularly, the invention relates to a hot rolled high strength low alloy steel or HSLA steel strip.

Hot rolled steels are often used without further processing such as cold rolling and annealing. Hot rolled steel can be used for engineering purposes or automotive purposes, for instance. Hot rolled steel strip is usually pickled and oiled. Due to the hot rolling, the surface quality is not as high as that of cold rolled steel strip.

Hot rolled steel strip can be produced on a traditional hot rolling mill, but also in a plant where the cast strip is directly reheated in a furnace and hot rolled.

HSLA steel strips are micro-alloyed to provide strength and to increase the temperature of non-recrystallisation. On the market several HSLA steel strip types are known, having different strength levels and micro-alloying elements.

One of such an HSLA steel strip is produced by the applicant of this patent application. Apart from the general elements Carbon, Manganese and Aluminium, this HSLA steel strip contains Niobium and Vanadium. Niobium is present in about 0.01 wt %. Vanadium is present in about 0.1 wt %.

It is an object of the present invention to provide a hot rolled steel strip, in particular an HSLA steel strip, having improved properties.

It is another object of the present invention to provide a hot rolled steel strip, in particular an HSLA steel strip, having a lower cost price than the known HSLA steel strip.

It is further object of the invention to provide a hot rolled steel strip, in particular an HSLA steel strip, having good mechanical properties.

In accordance with the invention one or more of these objects are reached by producing a hot rolled steel strip wherein the steel consists of the following elements, in wt. %:

| | |
|---|---|
| C | 0.02-0.07 |
| Mn | 0.50-1.60 |
| Si | ≤0.50 |
| Al | 0.01-0.10 |
| Nb | 0.01-0.03 |
| Ti | 0.01-0.07 |
| S | <0.02 |
| N | <0.02 |
| P | <0.05 |

wherein Nb+Ti≤0.08 and optionally one or more of the elements selected from:

| | |
|---|---|
| Cr | <0.20 |
| Mo | <0.10 |
| V | <0.05 |
| Cu | <0.20 |
| Sn | <0.20 |
| Ni | <0.20 |
| B | <0.0005 |
| Ca | <0.01 |

the remainder being iron and unavoidable impurities, wherein the steel has a tensile strength Rm of at least 400 MPa, and wherein the steel strip has a thickness of at least 1 mm and at most 5 mm.

In the hot rolled steel strip carbon, manganese and aluminium are added to provide strength and to bind residual elements. This is well-known to the person skilled in the art. The inventors have found that it is possible and advantageous to add niobium and titanium to the steel. Moreover, the inventors have found that only relative small amounts of these micro-alloying elements are needed to provide the steel with the required strength level. Furthermore, titanium is added to bind nitrogen. It has been found that when the steel strip is produced in a plant where the cast strip is directly reheated in a furnace and hot rolled, less nitrogen will be present in the steel and lower amounts of titanium can be used. The inventors think that the lower amounts of nitrogen are present because the steel is cooled very fast after finish rolling.

Niobium and titanium together should be present in an amount of at most 0.08 wt %. This low amount provides a cost advantage, especially in comparison to the use of vanadium, but it also means that only low amounts of inclusions will be formed, which results in better mechanical properties.

The optional elements as shown above can be present in the steel strip in the maximum amounts as mentioned, but are often only present as impurities due to steelmaking. Only calcium is always deliberately added.

According to preferred embodiments one or more of the elements mentioned above is present in a limited range, as is shown in claims 2 and 3.

Preferably the hot rolled steel strip according to the invention contains a combination of Nb+Ti that is at most 0.07 wt %, more preferably Nb+Ti is at most 0.06 wt %. The lower the amounts of these micro-alloying elements, the lower the cost of the steel strip.

On the other hand, preferably the hot rolled steel strip according to the invention contains a combination of Nb+Ti that is at least 0.03 wt %, more preferably Nb+Ti is at least 0.04 wt %. The micro-alloying elements have to be present in a sufficient amount to increase the temperature of non-recrystallisation.

According to a preferred embodiment the hot rolled steel strip according to the invention has a tensile strength Rm of 420-780 MPa, preferably a tensile strength of 460-720 MPa. Such strength levels are required by the use of the steel strip and are attainable with the composition according to the invention.

Furthermore the hot rolled steel strip according to the invention preferably has a yield strength Rp of 350-650 MPa, preferably a yield strength of 400-620 MPa. Such levels of the yield strength are often required by the manufacturers using the hot rolled steel.

According to a preferred embodiment the hot rolled steel strip according to the invention has an elongation A80 of at least 20%, preferably at least 25%, more preferably at least 30%. Due to the low amounts of micro-alloying elements the elongation is higher than in the known HLSA having a comparative strength level.

The invention will be elucidated on the basis of a few examples.

Hot rolled steel strip with the composition as shown in Table 1 and Table 2 has been evaluated based on a model to calculate mechanical properties.

Table 1 shows steel compositions 1-13 in which primarily the amount of Nitrogen, Niobium and Titanium varies. The steel strips are calculated with a finishing temperature of about 870° C. after which the strip is very fast cooled with a cooling velocity of about 250° C./s. Thereafter the strip is coiled at a temperature CT of about 630° C., as indicated in Table 1. The yield strength Rp, tensile strength Rm and elongation A80 of the steel types 1-13 is provided in Table 1 as well. These mechanical properties are given for the pickled strip.

The steel compositions in Table 1 all contain 0.03 wt % Cr, 0.024 wt % Cu and 0.029 wt % Ni. P is present in an amount of 0.015 wt % and S is present in an amount of 0.007 wt %. The amount of Ca is not given; Ca does not have an influence on the mechanical properties.

The Tables 1 and 2 show that when a higher coiling temperature CT is given, the elongation A80 appears to improve, but the strength will be somewhat lower. This would follows from steels number 5 and 25.

Furthermore, industrial trials have been performed.

Table 3 shows two compositions of the strips that have been cast and hot rolled.

Elements that are not mentioned in Table 3 are only present as impurity; only Ca is added in a usual amount, but Ca does not influence the mechanical properties.

TABLE 1 data of examples 1-13

| no | C | Mn | Si | Nsol | Al | V | Nb | Ti | CT(° C.) | Rp (MPa) | Rm (MPa) | A80% |
|---|---|---|---|---|---|---|---|---|---|---|---|---|
| 1 | 0.045 | 0.80 | 0.015 | 0.0035 | 0.035 | 0.001 | 0.013 | 0.03 | 630 | 472 | 525 | 23 |
| 2 | 0.045 | 0.80 | 0.015 | 0.0040 | 0.035 | 0.001 | 0.013 | 0.03 | 630 | 450 | 500 | 23 |
| 3 | 0.045 | 0.80 | 0.015 | 0.0040 | 0.035 | 0.001 | 0.013 | 0.03 | 610 | 520 | 612 | 20 |
| 4 | 0.045 | 0.80 | 0.015 | 0.0040 | 0.035 | 0.001 | 0.013 | 0.03 | 660 | 450 | 505 | 23 |
| 5 | 0.045 | 0.80 | 0.015 | 0.0040 | 0.035 | 0.001 | 0.013 | 0.03 | 680 | 470 | 506 | 25 |
| 6 | 0.045 | 0.80 | 0.015 | 0.0035 | 0.035 | 0.001 | 0.010 | 0.030 | 630 | 440 | 485 | 24 |
| 7 | 0.045 | 0.80 | 0.015 | 0.0035 | 0.035 | 0.001 | 0.016 | 0.030 | 630 | 501 | 554 | 23 |
| 8 | 0.045 | 0.80 | 0.015 | 0.0035 | 0.035 | 0.001 | 0.013 | 0.022 | 630 | 445 | 502 | 24 |
| 9 | 0.045 | 0.80 | 0.015 | 0.0035 | 0.035 | 0.001 | 0.013 | 0.038 | 630 | 585 | 645 | 20 |
| 10 | 0.045 | 0.80 | 0.015 | 0.0050 | 0.035 | 0.001 | 0.013 | 0.030 | 630 | 435 | 486 | 24 |
| 11 | 0.045 | 0.80 | 0.015 | 0.0030 | 0.035 | 0.001 | 0.013 | 0.030 | 630 | 494 | 546 | 23 |
| 12 | 0.045 | 0.80 | 0.015 | 0.0050 | 0.035 | 0.001 | 0.016 | 0.038 | 630 | 535 | 589 | 21 |
| 13 | 0.045 | 0.80 | 0.015 | 0.0030 | 0.035 | 0.001 | 0.010 | 0.022 | 630 | 420 | 472 | 23 |

Table 2 shows steel compositions 20-36 in which primarily the amount of Nitrogen, Niobium and Titanium varies. The steel strips are calculated with a finishing temperature of about 870° C. after which the strip is very fast cooled with a cooling velocity of about 250° C./s. Thereafter the strip is coiled at a temperature CT of about 620° C., as indicated in Table 2. The yield strength Rp, tensile strength Rm and elongation A80 of the steel types 20-36 is provided in Table 2 as well. The other elements are the same as in Table 1.

Table 2 shows that somewhat higher tensile and yield strength can be achieved with the compositions 20-36. It is assumed that this is due to the slightly higher amounts for niobium and titanium.

The steel strips are produced with a finishing temperature of about 870° C. after which the strip is very fast cooled with a cooling velocity of about 250° C./s in a plant where the cast strip is directly reheated in a furnace and hot rolled. However, production will also be possible in a hot rolling mill having a run out table with the required cooling capacity. The gauge of the strip, the coiling temperature and the mechanical properties yield strength Rp, tensile strength Rm and elongation A80 are provided in Table 4.

As shown in Table 4, for each composition 50 and 51 strips with different gauges have been hot rolled, which have also been coiled at different coiling temperatures CT.

TABLE 2 data of examples 20-36

| no | C | Mn | Si | Nsol | Al | V | Nb | Ti | CT(° C.) | Rp (MPa) | Rm (MPa) | A80% |
|---|---|---|---|---|---|---|---|---|---|---|---|---|
| 20 | 0.045 | 0.90 | 0.015 | 0.0035 | 0.04 | 0 | 0.02 | 0.04 | 610 | 507 | 560 | 21 |
| 21 | 0.045 | 0.90 | 0.015 | 0.0040 | 0.04 | 0 | 0.02 | 0.04 | 610 | 494 | 547 | 21 |
| 22 | 0.045 | 0.90 | 0.015 | 0.0045 | 0.04 | 0 | 0.02 | 0.04 | 610 | 495 | 548 | 21 |
| 23 | 0.045 | 0.90 | 0.015 | 0.0040 | 0.04 | 0 | 0.02 | 0.04 | 630 | 496 | 550 | 22 |
| 24 | 0.045 | 0.90 | 0.015 | 0.0040 | 0.04 | 0 | 0.02 | 0.04 | 660 | 508 | 554 | 23 |
| 25 | 0.045 | 0.90 | 0.015 | 0.0040 | 0.04 | 0 | 0.020 | 0.04 | 680 | 530 | 585 | 22 |
| 26 | 0.045 | 0.90 | 0.015 | 0.0035 | 0.04 | 0 | 0.015 | 0.04 | 610 | 482 | 537 | 23 |
| 27 | 0.045 | 0.90 | 0.015 | 0.0035 | 0.04 | 0 | 0.025 | 0.04 | 610 | 525 | 583 | 21 |
| 28 | 0.045 | 0.90 | 0.015 | 0.0035 | 0.04 | 0 | 0.020 | 0.03 | 610 | 494 | 548 | 21 |
| 29 | 0.045 | 0.90 | 0.015 | 0.0035 | 0.04 | 0 | 0.020 | 0.05 | 610 | 390 | 450 | 31 |
| 30 | 0.045 | 0.90 | 0.015 | 0.0050 | 0.04 | 0 | 0.020 | 0.04 | 610 | 493 | 547 | 22 |
| 31 | 0.045 | 0.90 | 0.015 | 0.0030 | 0.04 | 0 | 0.020 | 0.04 | 610 | 523 | 576 | 21 |
| 32 | 0.045 | 0.90 | 0.015 | 0.0050 | 0.04 | 0 | 0.025 | 0.05 | 610 | 517 | 566 | 23 |
| 33 | 0.045 | 0.90 | 0.015 | 0.0030 | 0.04 | 0 | 0.015 | 0.03 | 610 | 455 | 510 | 24 |
| 34 | 0.045 | 0.90 | 0.015 | 0.004 | 0.04 | 0 | 0.02 | 0.05 | 630 | 491 | 545 | 25 |
| 35 | 0.045 | 0.90 | 0.015 | 0.004 | 0.04 | 0 | 0.02 | 0.05 | 660 | 518 | 560 | 24 |
| 36 | 0.045 | 0.90 | 0.015 | 0.004 | 0.04 | 0 | 0.02 | 0.05 | 680 | 547 | 595 | 25 |

TABLE 3 composition of examples 50, 51 and 52

| Example | C | Mn | Si | Al | N | Nb | Ti | V | P |
|---|---|---|---|---|---|---|---|---|---|
| 50 | 0.045 | 0.8 | 0.016 | 0.03 | 0.0035 | 0.013 | 0.032 | 0.002 | 0.01 |
| 51 | 0.045 | 0.9 | 0.016 | 0.03 | 0.0035 | 0.02 | 0.042 | 0.002 | 0.01 |
| 52 | 0.045 | 0.9 | 0.016 | 0.03 | 0.040 | 0.02 | 0.052 | 0.002 | 0.01 |

TABLE 4 data of examples 50, 51 and 52

| Example | Gauge | CT | Rp | Rm | A80 (<3 mm) or Adp5(≥3 mm) |
|---|---|---|---|---|---|
| 50 | 1.8 | 660 | 474 | 548 | 22.0 |
| | 2.0 | 660 | 476 | 549 | 22.0 |
| | 2.5 | 660 | 450 | 534 | 23.2 |
| | 3.0 | 610 | 417 | 506 | 19.2 |
| | 3.0 | 630 | 443 | 524 | 22.3 |
| | 3.0 | 660 | 458 | 533 | 25.0 |
| | 3.0 | 680 | 442 | 511 | 24.9 |
| 51 | 1.8 | 660 | 531 | 601 | 20 |
| | 1.8 | 680 | 538 | 600 | 19.6 |
| | 2.0 | 610 | 495 | 557 | 20.1 |
| | 2.0 | 630 | 503 | 572 | 19.5 |
| | 2.0 | 680 | 543 | 603 | 20.5 |
| | 2.5 | 680 | 546 | 598 | 20.4 |
| | 3.0 | 610 | 466 | 534 | 21.5 |
| | 3.0 | 630 | 512 | 568 | 21.8 |
| | 3.0 | 660 | 500 | 560 | 21.5 |
| | 3.0 | 680 | 523 | 579 | 24.9 |
| 52 | 2.0 | 660 | 565 | 617 | 19 |
| | 2.0 | 680 | 579 | 634 | 18.7 |
| | 2.5 | 660 | 554 | 612 | 18.8 |
| | 3.0 | 630 | 530 | 610 | 24 |
| | 3.0 | 660 | 544 | 613 | 24 |
| | 3.0 | 680 | 568 | 626 | 24 |
| | 3.0 | 700 | 533 | 584 | 24.8 |

The examples in Tables 3 and 4 show that with low amounts of Nb and Ti a hot rolled strip in various gauges can be produced, which strips meet the requirements of yield strength Rp and tensile strength Rm, and which also possess a good elongation A80 (or Adp5 for gauges of 3 mm or thicker). A80 and Adp5 are determined following ISO 6892-1.

The invention claimed is:

1. A hot rolled steel strip wherein the steel consists of the following elements, in wt. %:

| | |
|---|---|
| C | 0.02-0.07 |
| Mn | 0.50-1.60 |
| Si | ≤0.50 |
| Al | 0.01-0.10 |
| Nb | 0.01-0.03 |
| Ti | 0.01-0.07 |
| S | <0.02 |
| N | <0.02 |
| P | <0.05 |
| V | <0.02 |

wherein Nb+Ti≤0.08 and optionally one or more of the elements selected from:

| | |
|---|---|
| Cr | <0.20 |
| Mo | <0.10 |
| Cu | <0.20 |
| Sn | <0.20 |

-continued

| | |
|---|---|
| Ni | <0.20 |
| B | <0.0005 |
| Ca | <0.01 |

the remainder being iron and unavoidable impurities, wherein the steel has a tensile strength Rm of at least 400 MPa, and wherein the steel strip has a thickness of at least 1 mm and at most 5 mm.

2. The hot rolled steel strip according to claim 1, wherein at least one of the following elements is present in a limited range of, in wt. %:

| | |
|---|---|
| C | 0.02-0.06 |
| Mn | 0.60-1.40 |
| Si | <0.40 |
| Al | 0.01-0.09 |
| Nb | 0.01-0.025 |
| Ti | 0.02-0.06 |
| S | <0.015 |
| N | <0.01 |
| P | <0.04 |

and optionally one or more of the following elements:

| | |
|---|---|
| Cr | <0.10 |
| Mo | <0.05 |
| Cu | <0.10 |
| Sn | <0.10 |
| Ni | <0.10 |
| B | <0.0005 |
| Ca | <0.008 |

the remainder being iron and unavoidable impurities.

3. The hot rolled steel strip according to claim 1, wherein at least one of the following elements is present in a limited range of, in wt. %

| | |
|---|---|
| C | 0.03-0.06 |
| Mn | 0.70-1.20 |
| Si | ≤0.30 |
| Al | 0.01-0.07 |
| Nb | 0.010-0.025 |
| Ti | 0.020-0.060 |
| S | <0.01 |
| N | <0.008 |
| P | <0.03 |
| V | <0.01 |

and optionally one or more of the elements selected from:

| | |
|---|---|
| Cr | <0.06 |
| Mo | <0.02 |
| Cu | <0.08 |
| Sn | <0.05 |
| Ni | <0.08 |
| B | <0.0005 |
| Ca | <0.006 |

the remainder being iron and unavoidable impurities.

4. The hot rolled steel strip according to claim 1, wherein one or more of Cr, Mo, V, Cu, Sn, Ni and B is present as an impurity.

5. The hot rolled steel strip according to claim 1, wherein Nb+Ti≤0.07 wt %.

6. The hot rolled steel strip according to claim 1, wherein Nb+Ti is in a range of 0.03 wt %-0.08 wt %.

7. The hot rolled steel strip according to claim 1, wherein the steel has a tensile strength Rm of 420-780 MPa.

8. The hot rolled steel strip according to claim 1, wherein the steel has a yield strength Rp of 350-650 MPa.

9. The hot rolled steel strip according to claim 1, wherein the steel has an elongation A80 of at least 20%.

10. The hot rolled steel strip according to claim 1, wherein the steel consists of the following elements, in wt. %:

| | |
|---|---|
| C | 0.02-0.06 |
| Mn | 0.60-1.40 |
| Si | ≤0.40 |
| Al | 0.01-0.09 |
| Nb | 0.01-0.025 |
| Ti | 0.02-0.06 |
| S | <0.015 |
| N | <0.01 |
| P | <0.04 |
| V | <0.02 |

and optionally one or more of the following elements:

| | |
|---|---|
| Cr | <0.10 |
| Mo | <0.05 |
| Cu | <0.10 |
| Sn | <0.10 |
| Ni | <0.10 |
| B | <0.0005 |
| Ca | <0.008 |

the remainder being iron and unavoidable impurities.

11. The hot rolled steel strip according to claim 1, wherein the steel consists of the following elements, in wt. %

| | |
|---|---|
| C | 0.03-0.06 |
| Mn | 0.70-1.20 |
| Si | ≤0.30 |

-continued

| | |
|---|---|
| Al | 0.01-0.07 |
| Nb | 0.010-0.025 |
| Ti | 0.020-0.060 |
| S | <0.01 |
| N | <0.008 |
| P | <0.03 |
| V | <0.01 |

and optionally one or more of the elements selected from:

| | |
|---|---|
| Cr | <0.06 |
| Mo | <0.02 |
| Cu | <0.08 |
| Sn | <0.05 |
| Ni | <0.08 |
| B | <0.0005 |
| Ca | <0.006 |

the remainder being iron and unavoidable impurities.

12. The hot rolled steel strip according to claim 1, wherein Mn is 0.50-0.90 wt %.

13. The hot rolled steel strip according to claim 1, wherein Nb+Ti≤0.06 wt %.

14. The hot rolled steel strip according to claim 1, wherein Nb+Ti is in a range of 0.04 wt %-0.08 wt %.

15. The hot rolled steel strip according to claim 1, wherein the steel has a tensile strength of 460-720 MPa.

16. The hot rolled steel strip according to claim 1, wherein the steel has a yield strength of 400-620 MPa.

17. The hot rolled steel strip according to claim 1, wherein the steel has an elongation A80 of at least 25%.

18. The hot rolled steel strip according to claim 1, wherein V<0.01.

* * * * *